US012601482B2

(12) United States Patent
Mathew et al.

(10) Patent No.: US 12,601,482 B2
(45) Date of Patent: Apr. 14, 2026

(54) SYSTEMS AND METHODS FOR OPERATING A FURNACE

(71) Applicant: Johnson Controls Light Commercial IP GmbH, Schaffhausen (CH)

(72) Inventors: Rakesh Mathew, Wichita, KS (US); Andrew Michael Boyd, Wichita, KS (US)

(73) Assignee: Johnson Controls Light Commercial IP GmbH, Schaffhausen (CH)

( * ) Notice: Subject to any disclaimer, the term of this patent is extended or adjusted under 35 U.S.C. 154(b) by 942 days.

(21) Appl. No.: 17/707,829

(22) Filed: Mar. 29, 2022

(65) Prior Publication Data

US 2023/0313989 A1 Oct. 5, 2023

(51) Int. Cl.
*F23N 5/20* (2006.01)
*F23N 5/02* (2006.01)

(52) U.S. Cl.
CPC ..... *F23N 5/203* (2013.01); *F23N 5/022* (2013.01); *F23N 2223/08* (2020.01); *F23N 2225/12* (2020.01); *F23N 2227/02* (2020.01); *F23N 2237/00* (2020.01); *F23N 2241/02* (2020.01)

(58) Field of Classification Search
CPC .. F23N 5/203; F23N 2227/02; F23N 2223/08; F23N 2225/12; F23N 2237/00; F23N 2241/02; F23N 5/022
See application file for complete search history.

(56) References Cited

U.S. PATENT DOCUMENTS

| | | | |
|---|---|---|---|
| 6,705,533 | B2 | 3/2004 | Casey et al. |
| 6,925,999 | B2 | 8/2005 | Hugghins et al. |
| 8,123,518 | B2 | 2/2012 | Nordberg et al. |
| 9,335,045 | B2 | 5/2016 | Kowald et al. |
| 9,447,985 | B2 | 9/2016 | Johnson |
| 9,453,648 | B2 | 9/2016 | Schultz et al. |
| 9,618,231 | B2 | 4/2017 | Kowald et al. |
| 9,625,177 | B2 | 4/2017 | Hrejsa et al. |
| 10,871,756 | B2 | 12/2020 | Johnson et al. |
| 10,908,578 | B2 | 2/2021 | Johnson et al. |
| 10,921,768 | B2 | 2/2021 | Johnson et al. |

(Continued)

FOREIGN PATENT DOCUMENTS

| | | | |
|---|---|---|---|
| CA | 2957726 | A1 | 3/2016 |
| CA | 3043996 | A1 | 2/2018 |

(Continued)

OTHER PUBLICATIONS

Lennox Service Literature, "SLP98DFV Series Units—Unit Information," Mar. 2014, 70 Pages, Lennox Industries Inc.

(Continued)

*Primary Examiner* — Steven S Anderson, II
(74) *Attorney, Agent, or Firm* — Kelly McGlashen

(57) ABSTRACT

A heating, ventilation, and/or air conditioning (HVAC) system includes a control system configured to initiate an operating cycle of a furnace of the HVAC system at an initial operating stage in response to a call for heating, monitor a duration of time associated with the operating cycle of the furnace to satisfy the call for heating, adjust the initial operating stage to provide an adjusted initial operating stage of the furnace based on the duration of time, and initiate a subsequent operating cycle of the furnace at the adjusted initial operating stage.

8 Claims, 7 Drawing Sheets

(56) References Cited

U.S. PATENT DOCUMENTS

| | | | | |
|---|---|---|---|---|
| 11,156,978 | B2 | 10/2021 | Johnson et al. | |
| 2013/0230812 | A1* | 9/2013 | Schultz | F24H 15/36 431/70 |
| 2022/0107105 | A1* | 4/2022 | Notaro | F24F 11/65 |

FOREIGN PATENT DOCUMENTS

| | | | |
|---|---|---|---|
| EP | 3 186 687 | A4 | 7/2017 |
| EP | 3 497 377 | A1 | 6/2019 |

OTHER PUBLICATIONS

CoolingLogic, "CoolingLogic: Up early, saving billions." URL: http://coolinglogic.com/documents/MarketingFlyer_FINAL_HiRes8.5x11.pdf, retrieved from internet Oct. 27, 2022 (1 page).

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "JLA Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).

Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).

Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).

Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).

Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).

Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).

Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).

Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).

Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).

Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).

Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).

Johnson Solid State LLC, "Cooling Logic Overview," URL: http://coolinglogic.com/documents/CoolingLogic_Overview_High_Quality.mp4, retrieved from internet Oct. 27, 2022 (16 pages).

Johnson Solid State LLC, "So what is CoolingLogic™?" URL: http://coolinglogic.com/Coolinglogic-How-it-Works.html, retrieved from the internet Oct. 27, 2022 (3 pages).

Johnson, David, "A Method to Increase HVAC System Efficiency and Decrease Energy Consumption," White Paper: Johnson Solid State, LLC, URL: http://coolinglogic.com/documents/16102106_White_Paper_High_Resolution_Protected.pdf, Sep. 24, 2016 (51 pages).

Johnson, David, "CoolingLogic™: Mosaic Christian Church a Case Study," Report: Johnson Solid State, LLC, URL: http://coolinglogic.com/documents/19020301_Mosaic_Christian_Coolinglogic_Case_Study.pdf, Feb. 2, 2019 (140 pages).

Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).

Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).

Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).

* cited by examiner

SYSTEMS AND METHODS FOR OPERATING A FURNACE

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties by controlling of a supply air flow delivered to a conditioned space. For example, the HVAC system may place the supply air flow in a heat exchange relationship with a refrigerant of a vapor compression circuit to condition the supply air flow before the supply air flow is delivered to the conditioned space. Some HVAC systems may include additional or alternative components configured to condition the supply air flow, such as a furnace, filters, energy recovery components, and so forth. Further, certain HVAC systems and/or HVAC system components may be configured to operate at different capacities, stages, or other variable operating levels. Unfortunately, existing HVAC systems may not operate to efficiently condition the conditioned space. For example, in certain instances, existing HVAC systems may not be configured to operate at a particular capacity or stage that provides more efficient conditioning. Additionally, some HVAC systems may include a combination of components that are unable to cooperatively achieve efficient operation of the HVAC system due to incompatibly between the components.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a control system configured to initiate an operating cycle of a furnace of the HVAC system at an initial operating stage in response to a call for heating, monitor a duration of time associated with the operating cycle of the furnace to satisfy the call for heating, adjust the initial operating stage to provide an adjusted initial operating stage of the furnace based on the duration of time, and initiate a subsequent operating cycle of the furnace at the adjusted initial operating stage.

In one embodiment, a tangible, non-transitory, computer-readable medium includes instructions that, when executed by processing circuitry, are configured to cause the processing circuitry to initiate an operating cycle of a furnace system at an initial operating stage, monitor a duration of time elapsed during operation of the furnace system in the operating cycle, and adjust the initial operating stage to provide an adjusted initial operating stage of the furnace system at which a subsequent operating cycle of the furnace system is initiated in response to a determination that respective durations of time of recent operating cycles have increased or decreased for a threshold quantity of consecutive recent operating cycles.

In one embodiment, a control system for a furnace system includes processing circuitry, and a memory with instructions that, when executed by the processing circuitry, cause the processing circuitry to operate the furnace system in a plurality of operating cycles to heat a conditioned space, each operating cycle of the plurality of operating cycles having an initial operating stage at which the respective operating cycle of the furnace system is initiated, monitor and store respective durations of time associated with the plurality of operating cycles, adjust a value of an operating parameter of the initial operating stage to provide an adjusted initial operating stage in response to a determination that the respective durations of time associated with the plurality of operating cycles increase or decrease for a threshold quantity of consecutive operating cycles, and initiate a subsequent operating cycle of the furnace system at the adjusted initial operating stage.

DESCRIPTION OF DRAWINGS

Various aspects of this disclosure may be better understood upon reading the following detailed description and upon reference to the drawings in which.

DETAILED DESCRIPTION

Figure 1:
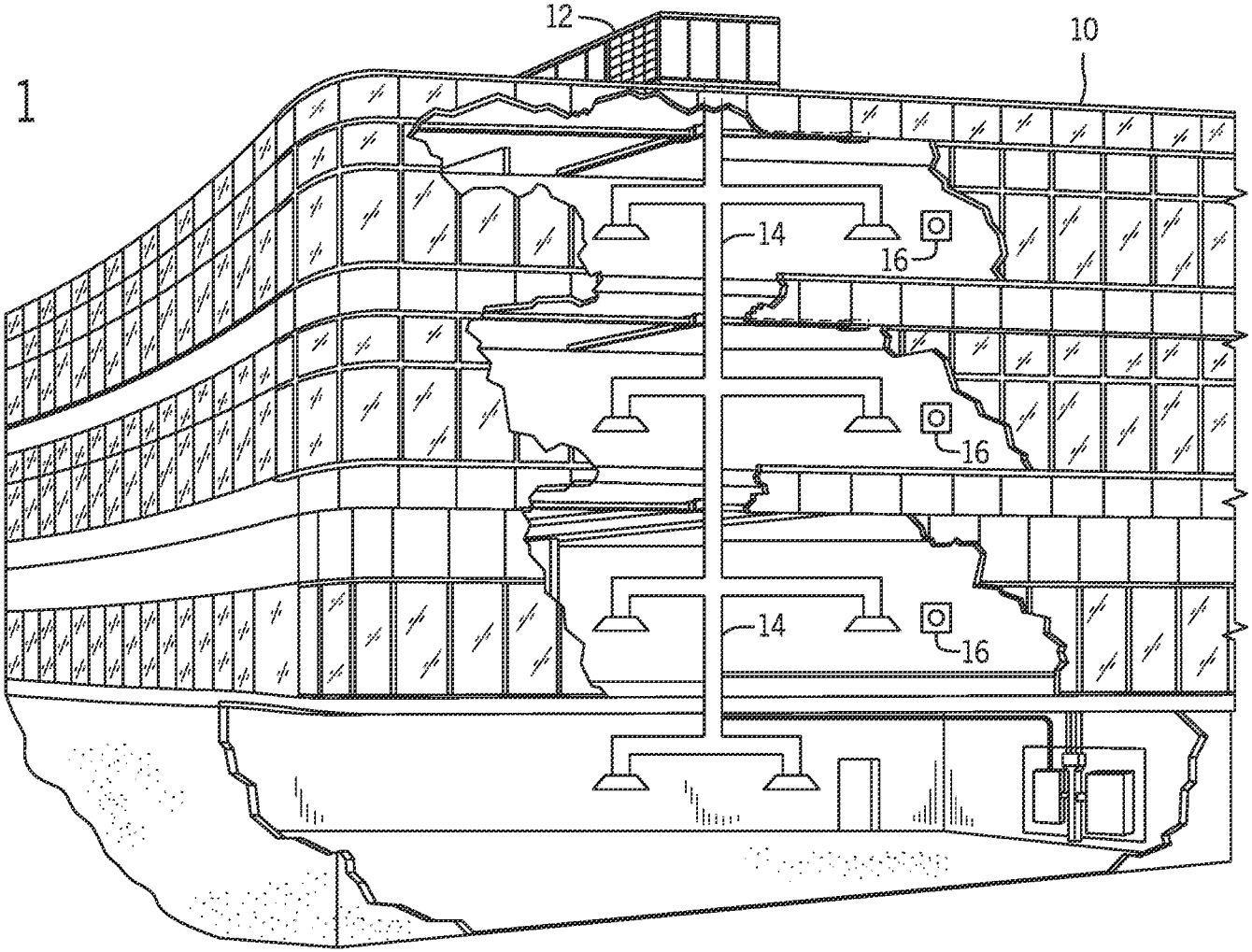
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to heating, ventilation, and/or air conditioning (HVAC) systems. An HVAC system may be configured to condition a space serviced by the HVAC system in response to a call for conditioning. For example, the HVAC system may receive a call for conditioning from a thermostat, which may be disposed within the space conditioned by the HVAC system. The HVAC system may include various heat exchange components or systems configured to condition an air flow (e.g., a supply air flow) that is supplied to the space. For example, the HVAC system may include a vapor compression system or circuit configured to circulate a working fluid, such as a refrigerant, and place the working fluid in a heat exchange relationship with the air flow to enable heating, cooling, and/or dehumidification of the air flow. In some embodiments, the HVAC system may include a furnace system configured to enable heating of the air flow. For example, in response to a call for heating, the HVAC system may initiate operation of the furnace to enable heating of the air flow, and the air flow may then be directed to the conditioned space in order heat the space to a target or desired temperature. In certain HVAC systems, the furnace system may continue to operate until the call for heating has been satisfied. Once the call for heating is satisfied, operation of the furnace system may be suspended. Operation of the furnace may remain suspended until another call for heating is received, at which point the HVAC system may initiate operation of the furnace system again. The following discussion describes operating cycles and/or cycles of operation of a furnace system. As used herein, an "operating cycle" or "cycle of operation" may refer to an operational period of the furnace system that initiates or starts when furnace system operation begins (e.g., in response to a received call for heating) and terminates or ends when furnace system operation is suspended (e.g., in response to the call for heating being satisfied).

In certain embodiments, the furnace system may be configured to operate at different stages, operating levels, and/or capacities. For example, the furnace system may be a two stage furnace, a multi-stage furnace configured to operate at more than two stages, or a modulating furnace. As will be appreciated, each operating stage may be associated with a particular operating capacity, firing rate, blower speed (e.g., draft inducer blower speed), and/or other operating parameter value of the furnace system. When operation of the furnace system is initiated (e.g., after a period of non-operation), the furnace system may initially operate at a particular (e.g., predetermined) operating level or stage. That is, each time a call for heating is received, the furnace system may begin operation at a particular operating stage (e.g., an initial operating stage). Unfortunately, in some circumstances, the particular operating stage may not enable a desired performance or efficiency of the furnace system to condition the space. As an example, initiation of furnace system operation at a predetermined initial operating stage may not enable the furnace system to condition the space efficiently. For instance, operation at the initial operating stage may not enable the furnace system to satisfy the call for heating (e.g., to achieve a target temperature within the space) in a time-efficient and/or cost-effective manner. As another example, operation of the furnace system at the initial operating stage may cause the furnace system to consume an undesired amount of energy or fuel to satisfy the call for heating.

Thus, it is presently recognized that improvements to staging operations of furnace systems are desired. Accordingly, embodiments of the present disclosure are directed to systems and methods that enable adjustment of furnace system operating stages. For example, the present techniques enable adjustment of an initial operating stage utilized upon startup or initiation of furnace system operation. As described in further detail below, furnace system staging operations may be adjusted based on various operating parameters that may be monitored and/or referenced by the furnace system to determine a particular operating stage (e.g., initial operating stage) to be utilized in subsequent furnace system operating cycles. For example, durations of time elapsed during previous operating cycles may be monitored and recorded for reference by furnace system. As used herein, a "duration of time" of an operating cycle may refer to the amount of time during which the furnace system operates to satisfy a call for heating (e.g., to achieve a target temperature in a conditioned space). The durations of time of the previous operating cycles may be stored and referenced to determine a desired initial operating stage of a subsequent operating cycle of the furnace system. Indeed, respective durations of time of multiple previous (e.g., most recent) operating cycles of the furnace system may be referenced and/or compared to one another to determine an adjustment to the initial operating stage of the furnace system in a subsequent or following operating cycle.

For instance, the furnace system may determine that the respective durations of time of multiple recent operating cycles increase consecutively for a threshold quantity of operating cycles, which may indicate that the furnace system operates longer than desired to satisfy recent calls for heating. Thus, the furnace system may determine that the next operating cycle of the furnace system should be initiated at an increased operating stage to provide an increased amount of heating (e.g., more quickly), thereby reducing the amount of time the furnace system operates to satisfy a subsequent call for heating. Similarly, the furnace system may determine that the respective durations of time for multiple recent operating cycles decrease consecutively for a threshold quantity of operating cycles, which may be indicative of the furnace system utilizing inefficient (e.g., excessive) amounts of fuel or energy to satisfy the previous calls for heating. In response to such a determination, the furnace system may determine that the initial operating stage for a subsequent operating cycle of the furnace system should be reduced. Reducing the initial operating stage may enable more efficient furnace system operation by reducing the amount of energy or fuel consumed to satisfy the subsequent call for heating. In accordance with the present techniques, operating stages of the furnace system may also be selected based on additional and/or alternative operating parameters, as described below. In this manner, furnace staging operations may be adjusted to heat the space and satisfy subsequent calls for heating more efficiently.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
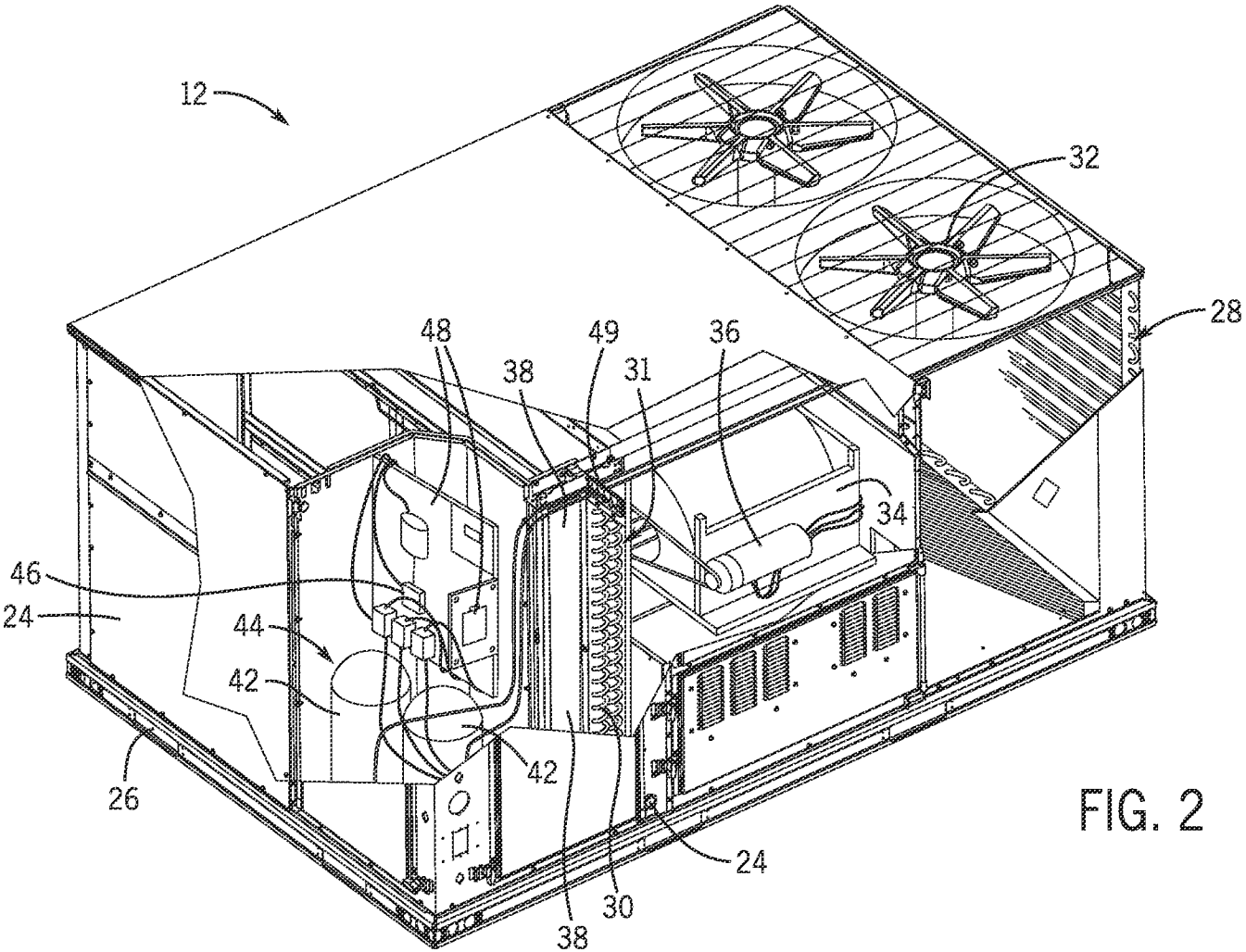
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
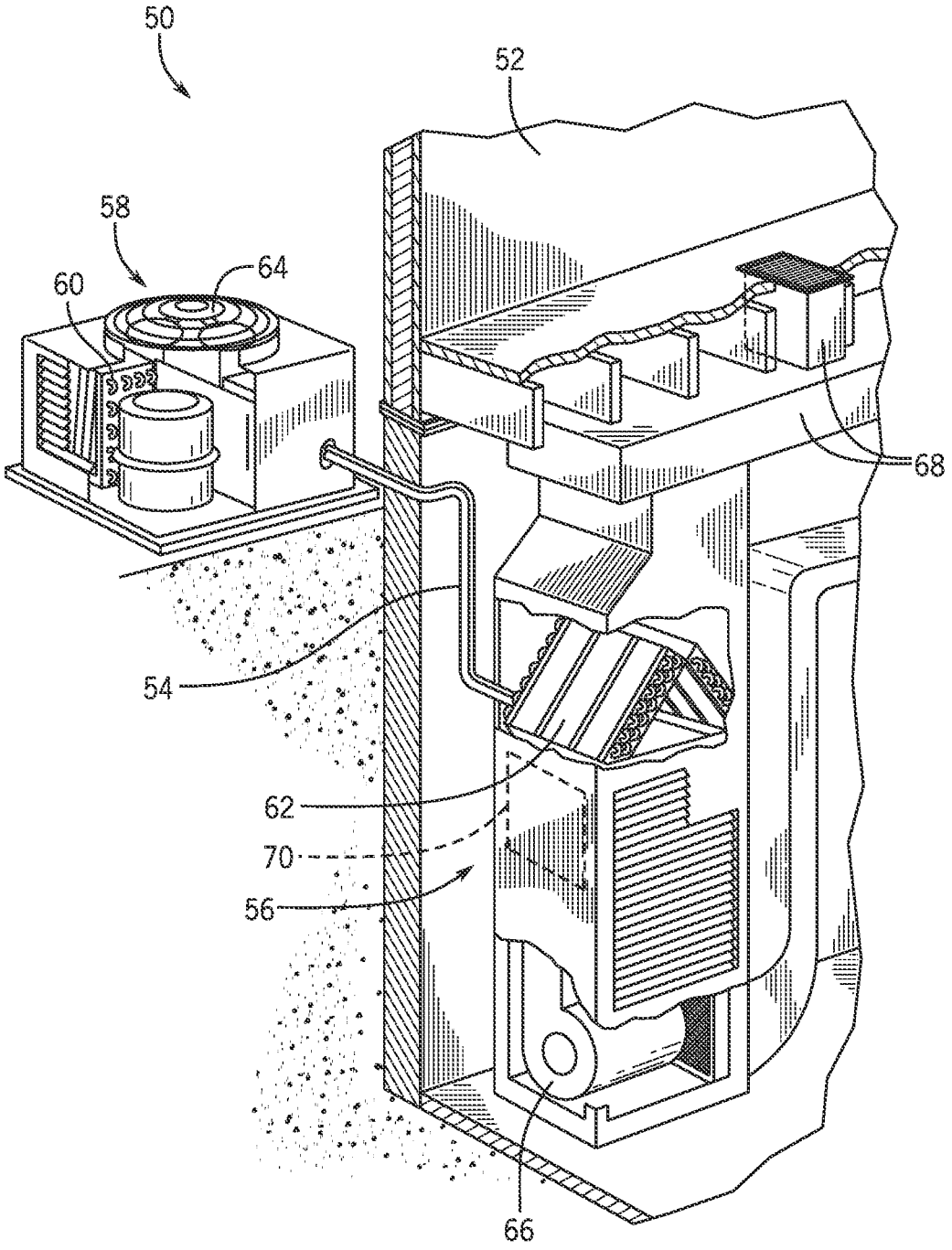
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature measured or detected inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
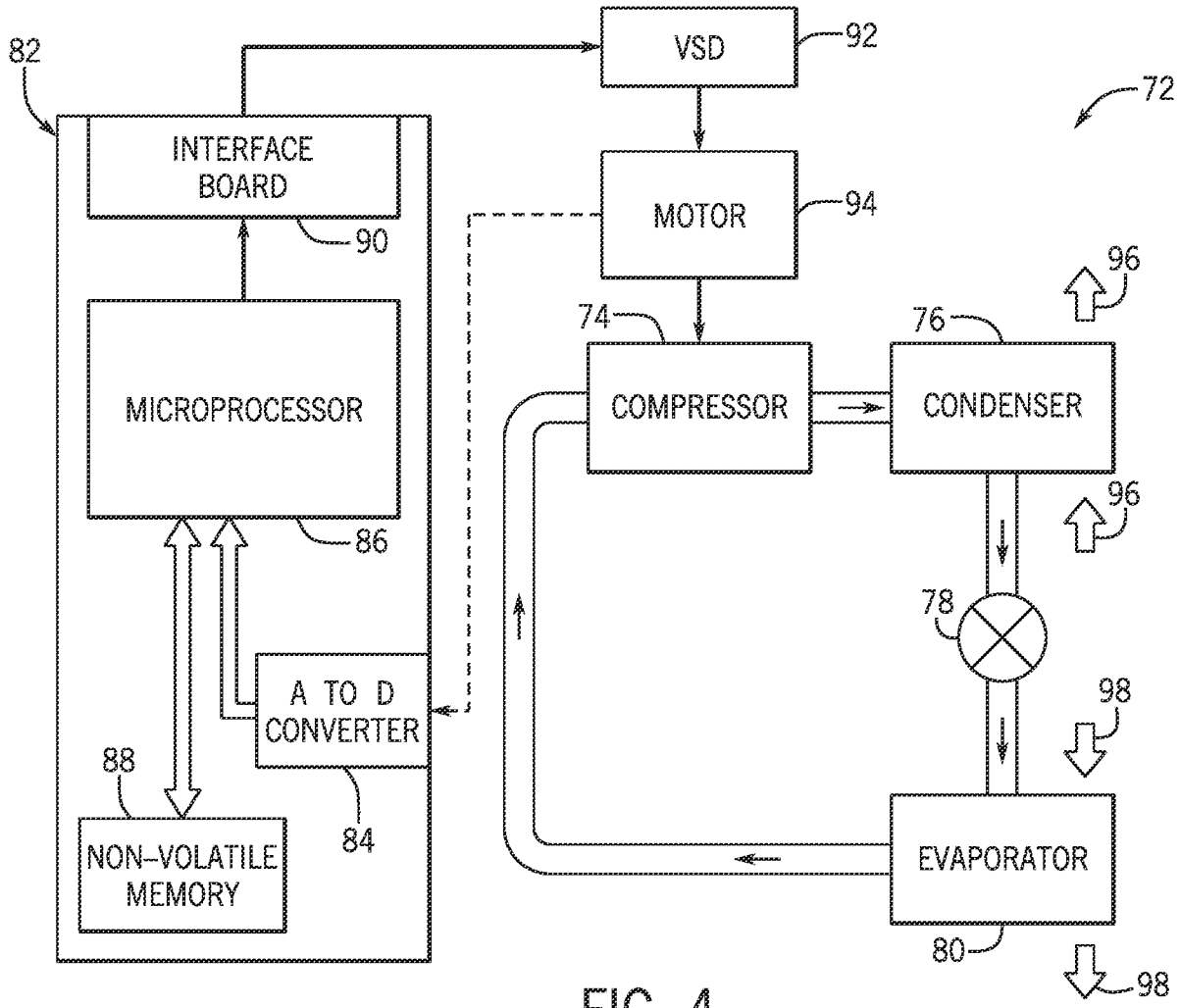
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly described above, the present disclosure is directed to a furnace system, such as a multi-stage or modulating furnace system configured to operate at two or more operating stages (e.g., operating capacities). The furnace system is configured determine or select an initial operating stage to be implemented in a subsequent (e.g., next or following) furnace system operating cycle (e.g., in response to a call for heating) based on various operating parameters of the furnace system. In particular, the furnace system may monitor, store, and/or reference operating parameters associated with a number of previous or most recent operating cycles of the furnace system, and the furnace system may determine or select a particular operating stage for initial implementation at the beginning of a subsequent operating cycle of the furnace system based on the operating parameters. For example, a respective duration of time associated with each of a number of previous operating cycles may be monitored and stored. As mentioned above, the duration of time of each previous operating cycle may be defined as the elapsed amount of time during which the furnace system operates to satisfy a respective call for heating in each operating cycle. In response to a determination that the durations of time progressively increase for consecutive previous operating cycles, the furnace system may determine that the next operating cycle of the furnace system should be initialized at an increased operating stage. Additionally or alternatively, in response to a determination that the durations of time progressively decrease for consecutive previous operating cycles, the furnace system may determine that the next operating cycle of the furnace system should be initialized at a decreased operating stage. In this way, the initial operating stage for a subsequent operating cycle of the furnace system may be adjusted to provide more efficient conditioning in response to a subsequent call for heating. For example, adjusting the initial operating stage may improve operation of the furnace system by enabling more efficient and/or effective (e.g., more timely) heating of a space. It should be appreciated that the techniques described herein may be implemented in any suitable HVAC system having a furnace or heating system, such as a packaged HVAC unit (e.g., the HVAC unit 12), a split HVAC system (e.g., heating and cooling system 50), an air handler unit, a heat pump system, and the like.

Figure 5:
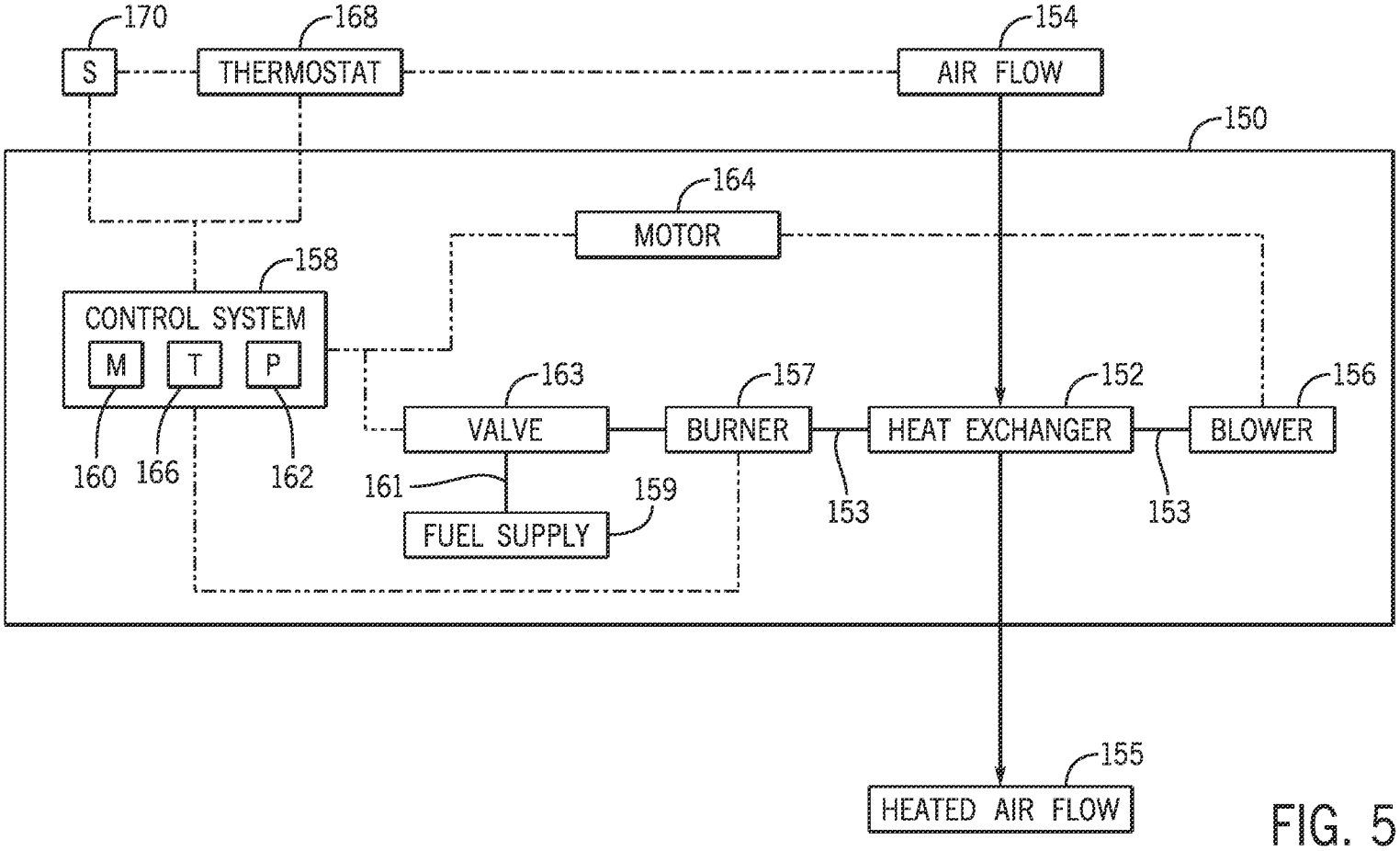
FIG. 5 is a schematic of an embodiment of a furnace system configured to operate with an improved staging operation scheme, in accordance with an aspect of the present disclosure.

With this in mind, FIG. 5 is a schematic of an embodiment of a furnace system 150 (e.g., the furnace system 70 of the residential heating and cooling system 50). The furnace system 150 (e.g., furnace) may include a heat exchanger 152 configured to heat an air flow 154 (e.g., a return air flow, an ambient air flow, a mixed air flow, a supply air flow) directed across the heat exchanger 152. By way of example, the heat exchanger 152 may include one or more tubes configured to receive combustion byproducts 153, and the heat exchanger 152 may place the air flow 154 in a heat exchange relationship with the combustion byproducts 153 to transfer heat from the combustion byproducts 153 to the air flow 154, thereby heating the air flow 154 to produce a heated air flow 155. The furnace system 150 may include a burner 157 configured to receive fuel 161 from a fuel supply 159. The burner 157 may ignite the fuel 161 (e.g., an air-fuel mixture) to produce the combustion byproducts 153, and a blower 156 (e.g., a draft inducer blower, fan, draft inducer) may direct (e.g., force, draw) the combustion byproducts 153 through the heat exchanger 152 (e.g., through tubes of the heat exchanger 152). In some embodiments, the furnace system 150 may include a valve 163 (e.g., a fuel valve) configured to control a flow rate of fuel 161 directed to the burner 157 and therefore control a rate at which the combustion byproducts 153 are produced by the burner 157 and directed through the heat exchanger 152. In some embodiments, the valve 163 may be operated to control an amount of fuel 161 in an air-fuel mixture generated by the burner 157, thereby enabling control of an amount of heat generated via the combustion byproducts 153 for transfer to the air flow 154. The furnace system 150 may also include an additional blower or fan configured to force the air flow 154 across the heat exchanger 152 and/or to deliver the heated air flow 155 to a space serviced by the furnace system 150 to heat the space.

The furnace system 150 may also include or be communicatively coupled to a control system 158 (e.g., an automation controller, a programmable controller, an electronic controller, a controller). The control system 158 may be part of the control panel 82, may include the control panel 82, or may be separate from the control panel 82. The control system 158 may include a memory 160 and processing circuitry 162. The memory 160 may include a non-transitory computer-readable medium that may include volatile memory, such as random-access memory (RAM), and/or non-volatile memory, such as read-only memory (ROM), flash memory, optical drives, hard disc drives, solid-state drives, or any other suitable non-transitory computer-readable medium storing instructions that, when executed by the processing circuitry 162, may control operation of the furnace system 150. To this end, the processing circuitry 162 may include one or more application specific integrated circuits (ASICs), one or more field programmable gate arrays (FPGAs), one or more programmable logic devices (PLD), one or more programmable logic arrays (PLA), one or more general purpose processors, or any combination thereof configured to execute such instructions.

In some embodiments, the furnace system 150 may be a multi-stage or modulating furnace system 150, and the control system 158 may be configured to operate the furnace system 150 at various operating stages or levels to control heating (e.g., an amount and/or a rate of heating) provided by the furnace system 150 to the air flow 154. For example, the control system 158 may be configured to control a flow rate of the combustion byproducts 153 directed through tubes of the heat exchanger 152. To this end, the control system 158 may be communicatively coupled to a motor 164 (e.g., a draft inducer motor) configured to drive operation of the blower 156. The motor 164 may include a VSD, and the control system 158 may increase a speed of the motor 164 to increase a flow rate of the combustion byproducts 153 directed through the heat exchanger 152. In this way, an amount of heat transfer to the air flow 154 may be increased. The control system 158 may also reduce a speed of the motor 164 to reduce the flow rate of the combustion byproducts 153 directed through the heat exchanger 152, thereby reducing the amount of heat transfer to the air flow 154.

Additionally or alternatively, the control system 158 may be communicatively coupled to the valve 163 to control a flow rate of the fuel 161 flowing into the burner 157. Adjusting the flow rate of fuel 161 flowing into the burner 157 may adjust the amount of combustion byproducts 153 generated via the burner 157 and/or an amount of heat generated via the combustion byproducts 153. Thus, the amount of heat available for transfer to the air flow 154 may be controlled via operation of the valve 163 (e.g., via adjusting a position of the valve). For instance, the control system 158 may increase an opening size of the valve 163 to increase the rate in which combustion byproducts 153 are generated by the burner 157 and/or an amount of heat generated via the combustion byproducts 153, thereby enabling increased heat transfer to the air flow 154. The control system 158 may also reduce the opening size of the valve 163 to reduce the rate of combustion byproducts 153 generated by the burner 157 and/or an amount of heat generated via the combustion byproducts 153, thereby enabling decreased heat transfer to the air flow 154.

Furthermore, the control system 158 may be communicatively coupled to the burner 157 to control a firing rate at which the burner 157 ignites the fuel 161 (e.g., air-fuel mixture) provided by the fuel supply 159. For example, the control system 158 may increase the firing rate of the burner 157 to increase the rate at which combustion byproducts 153 are generated to increase heat transfer to the air flow 154. The control system 158 may also reduce the firing rate of the burner 157 to reduce the rate at which combustion byproducts 153 are generated to decrease heat transfer to the air flow 154.

The control system 158 may be configured to initiate an operating cycle of the furnace system 150 at a particular operating stage or level (e.g., an operating capacity, a blower speed, a firing rate) in response to receipt of a call for heating. For example, the control system 158 may be communicatively coupled to a thermostat 168 configured to transmit the call for heating to the control system 158. The thermostat 168 may determine or establish a target temperature associated with a conditioned space (e.g., a target temperature within the space and/or a target temperature of a return air flow received from the space) serviced by the furnace system 150, such as based on a predetermined schedule and/or a user input. The control system 158 may also be communicatively coupled to one or more sensors 170 configured to monitor an operating parameter, such as a sensed, measured, detected, actual, or current temperature associated with the space (e.g., a detected temperature of a return air flow discharged from the space). In some embodiments, the thermostat 168 may be communicatively coupled to the sensor(s) 170 and may determine a difference between the measured temperature and the target temperature associated with the space. The thermostat 168 may transmit the call for heating based on the difference between the measured temperature and the target temperature, such as in response to the difference exceeding a threshold value. In additional or alternative embodiments, the control system 158 may receive the call for heating in response to a user input requesting heating of the space (e.g., independent of the measured temperature and/or the target temperature associated with the space). In further embodiments, the control system 158 may be directly communicatively coupled to the sensor(s) 170 and may receive data indicative of the measured temperature associated with the space from the sensor(s) 170. The control system 158 may also determine or establish the target temperature associated with the space based on data received from the thermostat 168, according to a schedule, and/or in response to a user input. The control system 158 may compare the measured temperature and the target temperature with one another and directly determine a call for heating based on a difference between the measured temperature and the target temperature (e.g., the difference exceeding a threshold value).

In response to the call for heating, the control system 158 may initiate an operating cycle of the furnace system 150. The control system 158 may initiate the operating cycle at an initial operating stage of the furnace system 150, and the initial operating stage may be associated with an initial speed of the motor 164, an initial firing rate of the burner 157, an initial opening size or position of the valve 163, and/or another initial operating parameter value of the furnace system 150. In the initial operating stage, the furnace system 150 may direct combustion byproducts 153 through the heat exchanger 152 at an initial flow rate.

In some embodiments, the control system 158 may be configured to receive different calls for heating (e.g., calls of different types, levels, stages). As an example, the control system 158 may receive a first stage (e.g., low stage) call for heating to provide reduced heating of the space, such as in response to a difference between the measured temperature and the target temperature associated with the space being above a first (e.g., low) threshold value (e.g., 0.5 degrees Celsius, 0.75 degrees Celsius, 1 degree Celsius) and/or a first (e.g., low) threshold percentage but below a second (e.g., high) threshold value or a second (e.g., high) threshold percentage. In response to receipt of the first stage call for heating, the control system 158 may initiate an operating cycle of the furnace system 150 at a lower initial operating stage (e.g., 65 percent firing rate, 70 percent firing rate, first stage), which may include operation of the motor 164 at a lower initial speed, operation of the burner 157 at a lower initial firing rate, and/or adjustment of the valve 163 to a reduced or smaller initial opening size. In some instances, the control system 158 may receive a second stage (e.g., high stage) call for heating to provide increased heating of the space, such as in response to a difference between the measured temperature and the target temperature associated with the space being above a second (e.g., high) threshold value (e.g., one degree Celsius, two degrees Celsius, three degrees Celsius) and/or a higher threshold percentage. In response to receipt of the second stage call for heating, the control system 158 may initiate an operating cycle of the furnace system 150 at an increased or higher initial operating stage (e.g., 100 percent firing rate, second stage), which may include operation of the motor 164 at a higher initial speed, operation of the burner 157 at a higher initial firing rate, and/or adjustment of the valve 163 to an increased or larger initial opening size.

Further still, in certain embodiments, the control system 158 may initiate an operating cycle of the furnace system 150 at an intermediate initial operating stage that is between the first or lower initial operating stage and the second or higher initial operating stage, such as in response to a call for heating that is between the first stage call for heating and the second stage call for heating. In some embodiments, after beginning the operating cycle in an initial operating stage, operation of the furnace system 150 may be subsequently adjusted during the operating cycle. For example, operation of the motor 164, burner 157, valve 163, and/or other component of the furnace system 150 may be adjusted during the operating cycle as the furnace system 150 continues operation to satisfy the call for heating.

As discussed above, the furnace system 150 may begin an operating cycle in one of multiple different initial operating stages. Respective operating parameters of each initial operating stage may be initially predetermined or preset prior to installation of the furnace system 150. For example, the respective operating parameters (e.g., motor 164 speed, burner 157 firing rate, valve 163 position, and so forth) of the initial operating stages may be determined and established during design and/or testing of the furnace system 150, such as by a manufacturer and/or operator, to enable desirable operation of the furnace system 150. In some embodiments, the respective operating parameters of the initial operating stages may be selected or determined based on a particular implementation of the furnace system 150, a characteristic of a space to be conditioned, a specification of a component of the furnace system 150, an ambient environment or condition of an installation site, or other suitable parameter. Initiating an operating cycle of the furnace system 150 at a particular initial operating may enable the furnace system 150 to operate more suitably (e.g., efficiently) to heat the space. For example, initiating an operating cycle of the furnace system 150 at a lower initial operating stage may enable the furnace system 150 to satisfy a reduced (e.g., first stage, low) call for heating without consuming an excessive amount of energy. Initiating an operating cycle of the furnace system 150 at a higher initial operating stage may enable the furnace system 150 to satisfy an increased (e.g., second stage, high) call for heating more quickly (e.g., within a threshold duration of time). Thus, initiating an operating cycle of the furnace system 150 at different initial operating stages, such as based on a particular type of call for heating received, may enable more efficient and desirable operation of the furnace system 150 to heat the space.

In certain embodiments, the control system 158 may maintain operation of the furnace system 150 in the initial operating stage (e.g., a lower initial operating stage, a higher initial operating stage) during the operating cycle until the call for heating is satisfied. For example, the control system 158 may maintain operation of the motor 164 at an initial speed (e.g., a lower initial speed, a higher initial speed), operation of the burner 157 at an initial firing rate, and/or the valve 163 at an initial opening size or position (e.g., a reduced initial opening size, an increased initial opening size) associated with the initial operating stage throughout the operating cycle of the furnace system 150. In additional or alternative embodiments, the control system 158 may adjust operation of the furnace system 150 from the initial operating stage during the operating cycle of the furnace system 150. That is, the control system 158 may initiate the operating cycle of the furnace system 150 at the initial operating stage and subsequently operate in a different operating stage during the same operating cycle. For example, after initially operating the furnace system 150 in the initial operating stage, the control system 158 may adjust (e.g., increase or decrease) adjust one or more operating parameters of the furnace system 150, such as a speed of the motor 164, a firing rate of the burner 157, and/or a position of the valve 163 to cause the furnace system 150 to operate in a different operating stage.

In some embodiments, after operating the furnace system 150 in the initial operating stage, the control system 158 may gradually reduce (e.g., step down) an operating parameter of the furnace system 150 (e.g., firing rate of the burner 157) until the operating parameter is at a minimum allowable value (e.g., 40 percent firing rate, 35 percent firing rate, 25 percent firing rate, 10 percent firing rate) and/or until the call for heating is satisfied. As another example, the control system 158 may gradually increase the operating parameter until the operating parameter of the furnace system 150 is at a maximum allowable value or limit (e.g., 100 percent firing rate, 95 percent firing rate, 90 percent firing rate) and/or until the call for heating has been satisfied. As a further example, the control system 158 may increase and decrease one or more operating parameters of the furnace system 150 during a single operating cycle (e.g., increase an operating parameter during a first duration of time in the operating cycle and reduce the operating parameter during a second duration of time in the same operating cycle).

In response to a determination that the call for heating is satisfied, such as based on the difference between the measured temperature and the target temperature associated with the space being below a threshold value (e.g., 0.1 degrees Celsius, 0.2 degrees Celsius), the control system 158 may suspend operation of the furnace system 150, thereby terminating the existing operating cycle. For instance, the control system 158 may suspend operation of the motor 164, suspend operation of the burner 157, and/or close the valve 163 to suspend production of combustion byproducts 153. Operation of the furnace system 150 may remain suspended until a subsequent call for heating is received, upon which the control system 158 may initiate a subsequent operating cycle to satisfy the subsequent call for heating.

In some circumstances, it may be desirable to adjust an initial operating stage to improve operation (e.g., efficiency) of the furnace system 150 to heat the space. For example, it may be desirable to adjust one or more operating parameters (e.g., preset or predetermined operating parameters) associated with the initial operating stage. However, in some instances, the thermostat 168 (e.g., a conventional thermostat, a non-communicating thermostat) may not be configured to provide data that enables adjustment to the initial operating stage of the furnace system 150. For example, some thermostats 168 may not enable efficient or desirable operation of two stage, multi-stage, and/or modulating furnace systems 150.

Accordingly, present embodiments of the control system 158 are configured to enable adjustment of the initial operating stage (e.g., operating parameters of the initial operating stage) of the furnace system 150 based on one or more parameters that may be detected, monitored, and/or referenced by the control system 158. In other words, the control system 158 may adjust an initial operating stage (e.g., associated with a call for heating or a type of call for heating) to provide an adjusted initial operating stage. Indeed, a rate, effectiveness, and/or efficiency at which the furnace system 150 heats the space (e.g., increases a temperature of the space) may change over time. For example, various factors, such as a quantity of occupants within the space, a change in a structure (e.g., insulation) that includes the space, and/or a change in the furnace system 150 (e.g., of a component of the furnace system 150), may affect operation of the furnace system 150 to satisfy calls for heating. To accommodate variations in such factors, the control system 158 is configured to adjust the initial operating stage at which an operating cycle of the furnace system 150 is initiated to enable more efficient heating of the space. For example, the control system 158 may monitor and reference data associated with previous operating cycles of the furnace system 150 to determine a desired adjustment to an initial operating stage of the furnace system 150 for a subsequent call for heating. As will be appreciated, the present techniques also enable more efficient and desirable operation of two stage, multi-stage, and/or modulating furnace systems 150 utilized with certain thermostats 168 (e.g., conventional thermostats, non-communicating thermostats).

In some embodiments, the control system 158 may be configured to monitor, store, and/or reference data indicative of respective durations of time of previous operating cycles. For example, the control system 158 may include a timer or clock 166 configured to monitor a duration of time in which an operating cycle of the furnace system 150 is active to satisfy a corresponding call for heating. In response to initiating the operating cycle, the control system 158 may initiate operation of the timer 166. In some embodiments, the control system 158 may begin monitoring an elapsed time indicated by the timer 166 and/or store a first time stamp (e.g., in the memory 160) indicated by the timer 166. Once the call for heating is satisfied (e.g., the operating cycle is suspended or terminated), the control system 158 may reference the elapsed time indicated by the timer 166 and/or store a second time stamp indicated by the timer 166. In this way, the control system 158 may determine a duration of time elapsed between initiation of the operating cycle and suspension of the operating cycle. The duration of time may indicate an amount of time during which the furnace system 150 operated to satisfy the call for heating via the operating cycle. The control system 158 may store the duration of time (e.g., within the memory 160) for subsequent reference by the control system 158. For instance, the control system 158 may reference stored durations of times associated with respective previous (e.g., recent) operating cycles to satisfy corresponding calls for heating to determine whether an adjustment to the initial operating stage of a subsequent operating cycle of the furnace system 150 is desired.

In some embodiments, the control system 158 may determine that an adjustment to the initial operating stage (e.g., to provide an adjusted initial operating stage) of a subsequent operating cycle of the furnace system 150 is desired based on a trend in respective durations of time of recent or previous operating cycles. As an example, in response to a determination that the durations of time progressively increase for a number (e.g., a threshold quantity) of consecutive previous or most recent operating cycles, the control system 158 may determine that the initial operating stage of a subsequent (e.g., next) operating cycle of the furnace system 150 should be adjusted to provide increased heating. The control system 158 may adjust the initial operating stage of the furnace system 150 for the next operating cycle by increasing a firing rate of the burner 157, increasing a speed of the motor 164, adjusting the valve 163 to provide an increase in flow rate of fuel 161, or otherwise increasing the heating provided via the initial operating stage. For example, the initial operating stage of the furnace system 150 (e.g., based on a particular call for heating received) may be typically be associated with a 70 percent firing rate of the burner 157, and in response to a determination that the durations of time progressively increase for a threshold quantity (e.g., three, four, five) of consecutive, most recent operating cycles, the control system 158 may increase the firing rate of the burner 157 to 80 percent for the initial operating stage of the next operating cycle of the furnace system 150. As will be appreciated, progressive increases of the respective durations of time for consecutive operating cycles may indicate that operation of the furnace system 150 utilizing the initial operating stage of the most recent operating cycles may not efficiently, desirably, or sufficiently heat the space serviced by the furnace system 150 (e.g., the furnace system 150 may not heat the space as quickly as desired). Thus, the control system 158 may adjust or increase the initial operating stage (e.g., increase the firing rate of the burner 157) to improve heating provided by the furnace system 150 in a subsequent (e.g., next) operating cycle.

As another example, in response to a determination that the durations of time progressively decrease for a number (e.g., a threshold quantity) of consecutive previous or most recent operating cycles, the control system 158 may determine that the initial operating stage of the next operating cycle of the furnace system 150 should be adjusted to provide decreased heating. The control system 158 may adjust the initial operating stage of the furnace system 150 for the next operating cycle by decreasing a firing rate of the burner 157, decreasing a speed of the motor 164, adjusting the valve 163 to provide a decrease in flow rate of fuel 161, or otherwise decreasing the heating provided via the initial operating stage. For example, the initial operating stage of the furnace system 150 (e.g., based on a particular call for heating received) may typically be associated with a 70 percent firing rate of the burner 157, and in response to a determination that the durations of time progressively decrease for a threshold quantity (e.g., three, four, five) of consecutive, most recent operating cycles, the control system 158 may decrease the firing rate of the burner 157 to 60 percent for the initial operating stage of the next operating cycle of the furnace system 150. Progressive decreases of the respective durations of time for consecutive operating cycles may indicate that operation of the furnace system 150 utilizing the initial operating stage of the most recent operating cycles may inefficiently heat the space serviced by the furnace system 150 (e.g., the furnace system 150 may utilize an excessive amount of energy to heat the space). Thus, the control system 158 may adjust or decrease the initial operating stage (e.g., increase the firing rate of the burner 157) to reduce energy consumed in a subsequent (e.g., next) operating cycle. In this manner, the control system 158 may adjust the initial operating stage of the furnace system 150 and implement an adjusted initial operating stage for a subsequent operating cycle of the furnace system 150 based on durations of time of previous operating cycles (e.g., by monitoring, storing, and/or referencing durations of time of previous operating cycles).

In certain embodiments, the control system 158 may be configured to store a quantity (e.g., a threshold quantity) of durations of time associated with respective previous operating cycles of the furnace system. For example, the control system 158 may store respective durations of time for three, four, five, or other suitable number (e.g., threshold quantity) of previous operating cycles. To store a new duration of time (e.g., associated with a most recent operating cycle) without exceeding the threshold quantity of stored durations of time, the oldest stored duration of time may be removed or deleted, such as after comparing the stored durations of time to one another to determine whether the stored durations of time progressively increase or decrease consecutively. In other words, the oldest stored duration of time may be erased to reduce the number of stored durations of time (e.g., below the quantity of stored durations of time) and enable storage of the new duration of time associated with the most recent operating cycle.

It should be noted that the control system 158 may refer to respective durations of time associated with certain operating cycles based on a type of call for heating received. For example, in response to receiving a first type of call for heating (e.g., a first stage call, a low stage call), the control system 158 may reference respective stored durations of time associated with previous operating cycles initiated to satisfy previous calls for heating of the first type (e.g., instead of referencing stored durations of time associated with previous operating cycles initiated to satisfy a previous calls for heating of a different type). Additionally, in response to receiving a second type of call for heating (e.g., a second stage call, a high stage call), the control system 158 may reference respective stored durations of time associated with previous operating cycles initiated to satisfy previous calls for heating of the second type (e.g., instead of referencing stored durations of time associated with previous operating cycles initiated to satisfy a previous calls for heating of the first type). In other words, in response to receiving a call for heating of a particular type, the control system 158 may reference respective durations of time associated with previous operating cycles initiated to satisfy the previous calls for heating of the same type.

Similarly, the control system 158 may also be configured to adjust the initial operating stage for a forthcoming operating cycle based on the particular type of the received call for heating. That is, in response to receiving a call for heating of a first type, the control system 158 may adjust the initial operating stage (e.g., a preset or predetermined initial operating stage) associated with the first type of call for heating to provide an adjusted initial operating stage for the first type of call for heating. Indeed, different types of calls for heating (e.g., first stage, second stage, low stage, high stage) may be associated with different initial operating stages, where each different initial operating stage is associated with particular operating parameter values (e.g., firing rate of the burner 157, position of the valve 163, speed of the motor 164). For example, in response to a determination that stored durations of time progressively increase or decrease consecutively for previous operating cycles associated with a first type of call for heating (e.g., a first stage call for heating), the control system 158 may increase or decrease, respectively, the initial operating stage for a subsequent operating cycle associated with the first type of call for heating. However, based on such a determination, the control system 158 may not adjust the initial operating stage for a subsequent operating cycle associated with a second type of call for heating. Similarly, in response to a determination that stored durations of time progressively increase or decrease consecutively for previous operating cycles associated with a second type of call for heating (e.g., a second stage call for heating), the control system 158 may increase or decrease, respectively, the initial operating stage for a subsequent operating cycle associated with the second type of call for heating, but the control system 158 may not adjust the initial operating stage for a subsequent operating cycle associated with the first type of call for heating.

The control system 158 may also adjust the initial operating stage based on other parameters or criteria. For example, the control system 158 may be configured to adjust the initial operating stage of a subsequent or next operating cycle in response to a determination that the most recent stored durations of time increase at a rate or amount that is greater than a threshold value without considering a quantity of previous operating cycles associated with the durations of time. For instance, in such embodiments, the initial operating stage may be adjusted to increase heating (e.g., increase firing rate of the burner 157) in response to a determination that the rate or amount of increase (e.g., increase in time) between most recent stored durations of time (e.g., two most recent stored durations of time) is greater than the threshold value even though a quantity of previous operating cycles associated with the most recent stored durations of time may be below a threshold quantity. Moreover, the initial operating stage may be adjusted to reduce heating (e.g., decrease firing rate of the burner 157) in response to a determination that the rate or amount of decrease (e.g., decrease in time) between most recent stored durations of time is greater than the threshold value even though a quantity of previous operating cycles associated with the most recent stored durations of time may be below a threshold quantity.

Figure 6:
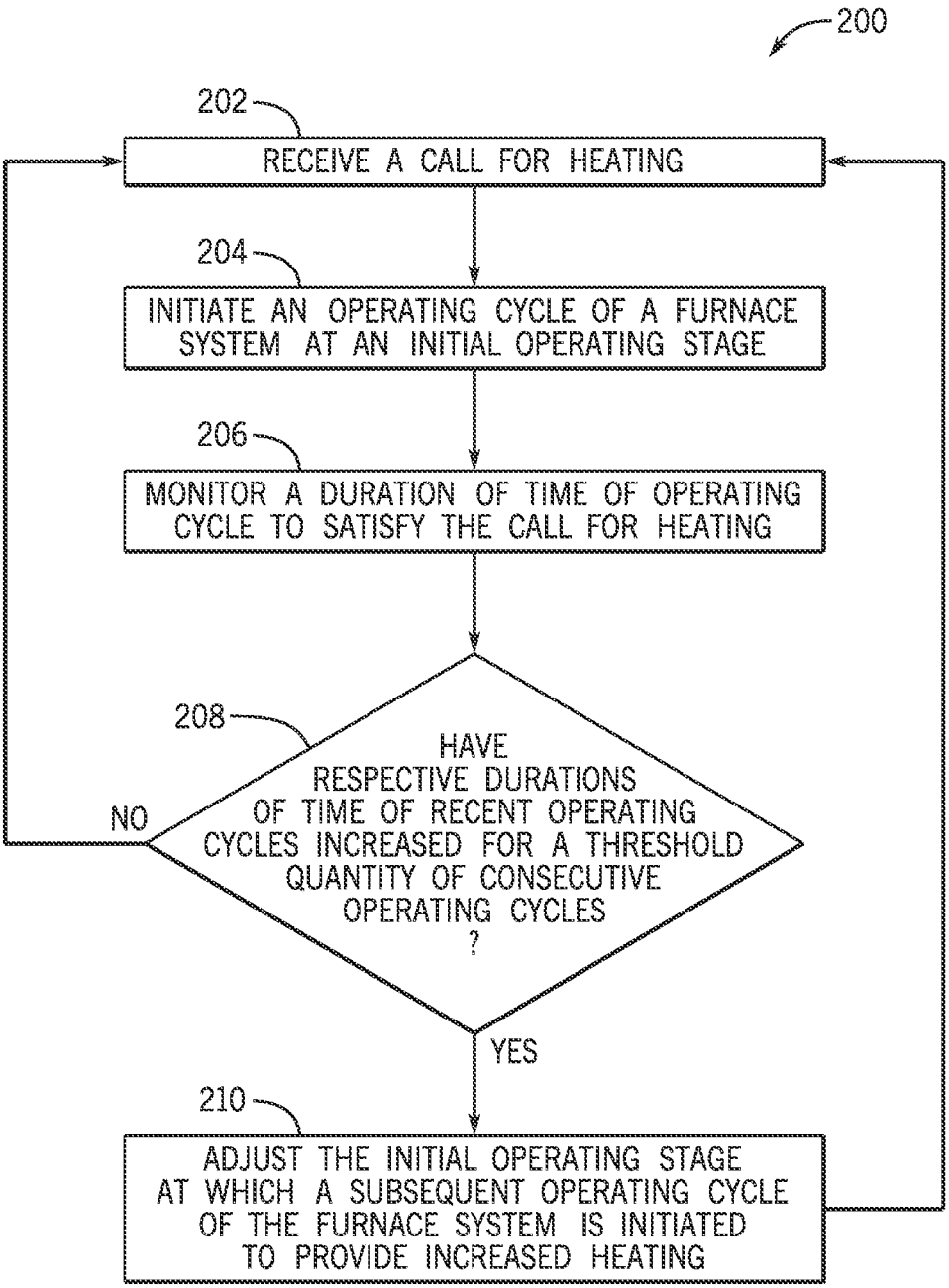
FIG. 6 is a flowchart of an embodiment of a method or process for operating a furnace system with an improved staging operation scheme, in accordance with an aspect of the present disclosure.
Figure 7:
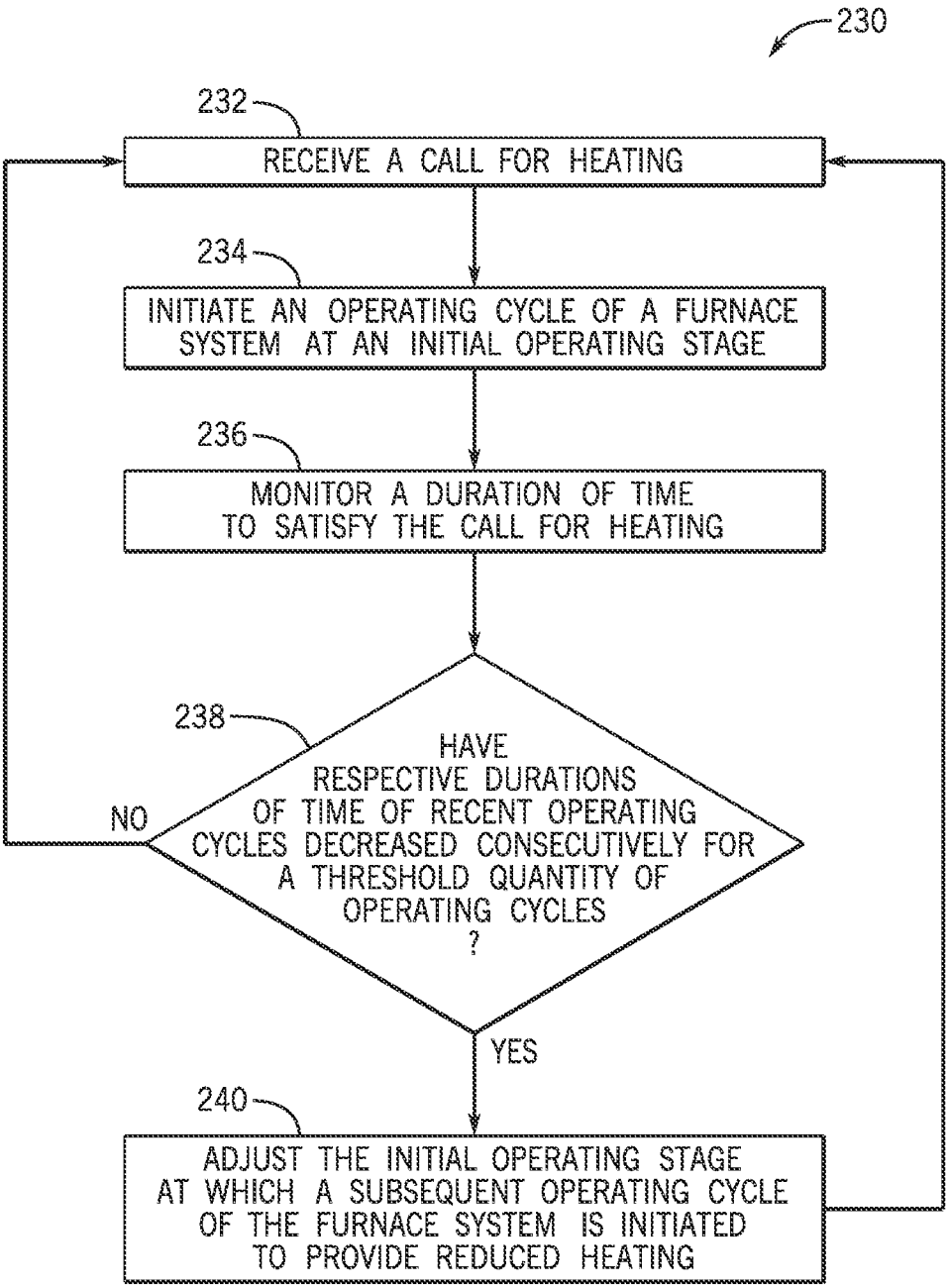
FIG. 7 is a flowchart of an embodiment of a method or process for operating a furnace system with an improved staging operation scheme, in accordance with an aspect of the present disclosure.

FIGS. 6 and 7 each illustrate an embodiment of a method or process for operating the furnace system 150, in accordance with the present techniques. In some embodiments, the respective methods and/or one or more of the steps thereof may be performed by a single respective component or system, such as by the control system 158 (e.g., the processing circuitry 162) or other HVAC system controller. In additional or alternative embodiments, multiple components or systems of the furnace system 150 and/or a system having the furnace system 150 may perform one or more steps of the respective methods. It should also be noted that additional steps may be performed with respect to the methods described herein. Moreover, certain steps of each method may be removed, modified, and/or performed in a different order.

FIG. 6 is a flowchart of an embodiment of a method or process 200 for operating the furnace system 150. At block 202, a call for heating may be received by the control system 158 or other HVAC system controller. In some embodiments, the call for heating may be transmitted from the thermostat 168, which may be a conventional or non-communicating thermostat. As an example, the thermostat 168 may be configured to transmit the call for heating in response to a determination that a difference between a measured temperature (e.g., a measured temperature of a conditioned space, a measured temperature of return air received by the HVAC system) and a target temperature associated with the conditioned space serviced by the furnace system 150 exceeds a threshold value. Additionally or alternatively, the thermostat 168 may transmit the call for heating in response to a user input. In additional or alternative embodiments, the call for heating may be determined by the control system 158. For example, data indicative of the measured temperature associated with the space (e.g., a measured temperature of return air) may be transmitted to the control system 158 by the sensor(s) 170. The target temperature associated with the space may be determined by the control system 158 based on data received from the thermostat 168 and/or based on a user input. The control system 158 may determine that a call for heating exists in response to a determination that a difference between the measured temperature and the target temperature exceeds a threshold value.

At block 204, in response to receipt of the call for heating, an operating cycle of the furnace system 150 may be initiated at an initial (e.g., unadjusted) operating stage. In certain embodiments, such as prior to operation of the furnace system 150 in previous operating cycles, the initial operating stage may include a baseline, original, or default initial operating stage that may be predetermined and/or preset prior to installation of the furnace system 150. The initial operating stage may also be selected based on a type of the call for heating received (e.g., a first stage call, a second stage call). As will be appreciated, the initial operating stage may be associated with particular operating parameters of the furnace system 150 (e.g., baseline, predetermined, and/or preset operating parameters). For example, the initial operating stage may include an initial or preset firing rate of the burner 157, an initial or preset speed of the motor 164, an initial or preset opening size (e.g., position) of the valve 163, and so forth. The control system 158 may then implement the initial operating stage to operating furnace system 150 in an operating cycle to satisfy the call for heating. In some embodiments, operation of the furnace system 150 may be maintained at the initial operating stage (e.g., utilizing operating parameters associated with the initial operating stage) during an entirety of the operating cycle and/or until the call for heating is satisfied. Additionally or alternatively, the control system 158 may operate the furnace system 150 to deviate from the initial operating stage during the operating cycle. For example, after a particular time period of operation in the initial operating stage during the operating cycle, the control system 158 may periodically reduce (e.g., step down) the firing rate of the burner 157 during the operating cycle until the call for heating is satisfied.

At block 206, the control system 158 may monitor a duration of time during which the furnace system 150 operates in the current operating cycle to satisfy the call for heating. To this end, the control system 158 may operate the timer 166 to track an amount of time elapsed from initiation of the operating cycle to suspension of the operating cycle. In some embodiments, the control system 158 may store a time stamp upon initiation of the operating cycle at the initial operating stage. After the call for heating is satisfied, the operating cycle of the furnace system 150 may be suspended, and the control system 158 may reference the timer 166 and/or the time stamp to determine the duration of time or an amount of time elapsed between initiation and suspension of the operating cycle. In some embodiments, the control system 158 may store an additional time stamp upon suspension of the operating cycle to determine the duration of time. The duration of time may then be stored for subsequent retrieval and/or reference by the control system 158. In some embodiments, the control system 158 may monitor and store (e.g., in the memory 160) a respective duration of time for each of multiple operating cycles of the furnace system 150. For example, the control system 158 may be configured to monitor and store respective durations of time for a particular quantity (e.g., three, four, five) of most recent operating cycles. In accordance with the present techniques, the stored durations of time may be subsequently referenced (e.g., compared to one another) to determine whether an adjustment to an initial operating stage of the furnace system 150 is desired.

At block 208, stored durations of time associated with recent operating cycles of the furnace system 150 may be referenced by the control system 158. For example, the control system 158 may reference durations of time associated with recent operating cycles stored in the memory 160. The control system 158 may compare the stored durations of time with one another to determine whether the durations of time progressively increase for consecutive recent operating cycles. In some embodiments, the control system 158 may determine whether the stored durations of time progressively increase (e.g., from an oldest stored duration of time to a most recent stored duration of time) for a threshold quantity of consecutive previous operating cycles. As discussed above, a particular number of durations of time, such as two durations of time, three durations of time, or more than three durations of time, associated with respective previous operating cycles may be stored in the memory 160. The number of stored durations of time may be equal to or greater than the threshold quantity of consecutive previous operating cycles.

In response to a determination that the respective stored durations of time have not progressively increased for the threshold quantity of operating cycles (e.g., the stored durations of time do not progressively increase for consecutive previous operating cycles, the stored durations of time progressively increase for a quantity of consecutive previous operating cycles less than the threshold quantity), the initial operating stage associated with the call for heating received at block 202 may not be adjusted by the control system 158. Thus, in response to receipt of a subsequent call for heating of the same type as the call for heating received at block 202, the control system 158 may initiate a new operating cycle of the furnace system 150 utilizing the same initial operating stage with which the most recent operating cycle was initiated.

However, in response to a determination that the stored durations of time progressively increase for the threshold quantity of consecutive operating cycles, the initial operating stage may be adjusted for a subsequent operating cycle, as described at block 210. For example, an operating parameter associated with the initial operating stage may be adjusted to provide an adjusted initial operating stage. In response to receipt of a subsequent call for heating (e.g., of the same type as the call for heating received at block 202), a subsequent operating cycle of the furnace system 150 may be initiated utilizing the adjusted initial operating stage. The adjusted initial operating stage may enable operation of the furnace system 150 to provide increased heating in response to the subsequent call for heating. As discussed above, the progressive increase of the most recent stored durations of time may indicate that initializing an operating cycle of the furnace system 150 at a particular initial operating stage may not efficiently, adequately, or desirably satisfy received calls for heating. Thus, the control system 158 may implement the adjusted initial operating stage in response to a subsequent call for heating to enable the furnace system 150 to provide increased heating to satisfy the subsequent call for heating. For example, the adjusted initial operating stage may include an increased firing rate of the burner 157, as compared to the firing rate of the burner 157 in the unadjusted or previous initial operating stage. In some embodiments, a notification may be transmitted based on implementation of the adjusted initial operating stage. For instance, the notification may be transmitted to inform a user (e.g., an operator, a technician, an operator) that the operation of the furnace system 150 has been adjusted based on previous operating cycles of the furnace system 150.

The method 200 may be iteratively performed during operation of the furnace system 150. That is, the initial operating stage of the furnace system 150 may be iteratively adjusted each time a determination is made that the stored durations of time for recent operating cycles progressively increase for the threshold quantity of consecutive operating cycles. In some embodiments, one or more operating parameters of the initial operating stage may be iteratively adjusted at fixed or constant amount, value, rate, or percentage. For example, the control system 158 may increase the firing rate of the burner 157 by ten percent in response to each determination that adjustment to an existing initial operating stage is desired in the method 200. In additional or alternative embodiments, adjustments to the initial operating stage (e.g., one or more operating parameters of the initial operating stage) may be determined based on an amount of increase (e.g., a rate of increase) between the stored durations of time. For example, the firing rate of the burner 157 may be increased by an increased amount in response to a determination that the stored durations of time increase at a greater rate or by a greater amount. Similarly, the firing rate of the burner 157 may be increased by a smaller amount in response to a determination that the stored durations of time increased at a smaller rate or by a smaller amount.

In some embodiments, one or more operating parameters of an initial operating stage (e.g., a preset initial operating stage, an adjusted initial operating stage) may be associated with a maximum allowable value that may be utilized with an initial operating stage. For example, the firing rate of the burner 157, the speed of the motor 164, the opening size (e.g., position) of the valve 163, or other operating parameter of the furnace system 150 may be iteratively adjusted or increased, in accordance with the techniques described herein, up to a particular value (e.g., a maximum allowable value) associated with the particular operating parameter. In such embodiments, the control system 158 may not adjust the initial operating stage to provide an adjusted initial operating stage with an operating parameter value greater than the maximum allowable value.

FIG. 7 is a flowchart of an embodiment of a method or process 230 for operating the furnace system 150. As similarly discussed above with reference to FIG. 6, a call for heating may be received or determined by the control system 158, such as via the thermostat 168 and/or via data received from the sensor(s) 170, as indicated by block 232. At block 234, the control system 158 may initiate an operating cycle of the furnace system 150 at an initial operating stage to satisfy the call for heating. At block 236, a duration of time during which the furnace system 150 operates in the operating cycle to satisfy the call for heating may be monitored (e.g., via the timer 166) and stored (e.g., in the memory 160).

At block 238, stored durations of time associated with recent operating cycles of the furnace system 150 may be referenced by the control system 158. The control system 158 may compare the stored durations of time with one another to determine whether the durations of time progressively decrease for a threshold quantity of consecutive recent operating cycles. In response to a determination that the stored durations of time do not progressively decrease for the threshold quantity of consecutive previous operating cycles (e.g., the stored durations of time do not progressively decrease for consecutive previous operating cycles, the stored durations of time progressively decrease for a quantity of consecutive previous operating cycles less than the threshold quantity), the initial operating stage associated with the call for heating received at block 232 may not be adjusted by the control system 158.

In response to a determination that the stored durations of time progressively decrease for the threshold quantity of consecutive operating cycles, the initial operating stage may be adjusted for a subsequent operating cycle of the furnace system 150. For example, an operating parameter associated with the initial operating stage may be adjusted to provide an adjusted initial operating stage, and the adjusted initial operating stage may enable operation of the furnace system 150 to provide reduced heating in response to a subsequent call for heating, as described at block 240. As previously discussed, the progressive decrease of the most recent stored durations of time may indicate that initializing an operating cycle of the furnace system 150 at a particular initial operating stage may not efficiently satisfy calls for heating. Thus, the control system 158 may implement the adjusted initial operating stage in response to a subsequent call for heating to enable the furnace system 150 to provide more efficient heating to satisfy the subsequent call for heating. For example, the adjusted initial operating stage may include a reduced firing rate of the burner 157 as compared to the firing rate of the burner 157 in the initial (e.g., unadjusted) operating stage. A notification may also be transmitted based on implementation of the adjusted initial operating stage to inform a user that the operation of the furnace system 150 has been adjusted.

The method 230 may also be iteratively performed during operation of the furnace system 150. In this way, the initial operating stage of the furnace system 150 may be iteratively adjusted each time a determination is made that the stored durations of time for recent operating cycles progressively decrease for the threshold quantity of consecutive operating cycles. Indeed, the initial operating stage may be iteratively adjusted at a fixed or constant amount, value, rate, or percentage. For example, the control system 158 may reduce the firing rate of the burner 157 by ten percent in response to each determination that adjustment to an existing initial operating stage is desired in the method 230. Additionally or alternatively, adjustments to the initial operating stage (e.g., one or more operating parameters of the initial operating stage) may be determined based on an amount of decrease (e.g., a rate of decrease) between the stored durations of time.

In some embodiments, one or more operating parameters of an initial operating stage (e.g., a preset initial operating stage, an adjusted initial operating stage) may be associated with a minimum allowable value or limit that may be utilized with an initial operating stage. For example, the firing rate of the burner 157, the speed of the motor 164, the opening size of the valve 163, or other operating parameter of the furnace system 150 may be iteratively adjusted or increased, in accordance with the techniques described herein, down to a particular value (e.g., the minimum allowable value) associated with the particular operating parameter. In such embodiments, the control system 158 may not adjust the initial operating stage to provide an adjusted initial operating stage with an operating parameter value lower than an associated minimum allowable value.

In some embodiments, each of the methods 200, 230 may be performed to adjust the initial operating stage. As an example, the control system 158 may be configured to initiate an operating cycle of the furnace system 150 at a first initial operating stage. In response to a determination that stored durations of time of recent operating cycles progressively increase for a threshold quantity of consecutive operating cycles, the control system 158 may determine that a subsequent operating cycle of the furnace system should be initiated utilizing a second initial operating stage, instead of the first initial operating stage, to provide increased heating in response to a subsequent call for heating. After implementing the second initial operating stage in a subsequent operating cycle of the furnace system 150, the control system 158 may determine that stored durations of time of most recent operating cycles progressively decrease for a threshold quantity of consecutive operating cycles. In response, the control system 158 may determine that a subsequent operating cycle of the furnace system should be initiated utilizing a third initial operating stage, which may be similar to the first initial operating stage. In this manner, the initial operating stage of the furnace system 150 may be iteratively adjusted (e.g., increased and decreased) based on the monitored durations of time associated with previous operating cycles.

Additionally, in embodiments of the furnace system 150 configured to operate in different initial operating stages based on a type of the call for heating received, at least one of the methods 200, 230 may be performed referencing stored durations of time associated with the particular type of call of heating received. As an example, the methods 200, 230 may be performed in response to receipt of a first type of call for heating (e.g., a first stage call), and stored durations of time of recent operating cycles associated with calls for heating of the first type may be compared with one another. The control system 158 may then determine whether the initial operating stage for a subsequent operating cycle initiated in response to a subsequent a call for heating of the first type should be adjusted. Similarly, the methods 200, 230 may be performed in response to receipt of a second type of call for heating (e.g., a second stage call), and stored durations of time of recent operating cycles associated with calls for heating of the second type may be compared to one another. The control system 158 may then determine whether the initial operating stage for a subsequent operating cycle initiated in response to a subsequent a call for heating of the second type should be adjusted. As such, different types of calls for heating may be received (e.g., the same type of call for heating may not be consecutively received), and stored durations of time of previous operating cycles associated with one type of call for heating may not be referenced to determine whether adjustment to an initial operating stage for an operating cycle associated with another type of call for heating is desired.

In this manner, in embodiments of the furnace system 150 configured to operate in different initial operating stages based on a type of the call for heating received, the respective initial operating stages may be independently adjusted. That is, adjustment of a first initial operating stage associated with a first type of call for heating may not affect a second initial operating stage associated with a second type of call for heating. For example, in response to receipt of a first stage call for heating, an operating cycle of the furnace system 150 may be initiated at an initial operating stage that includes a 70 percent firing rate of the burner 157. In response to a determination that stored durations of time of recent operating cycles associated with first stage calls for heating progressively increase for a threshold quantity of consecutive operating cycles, the initial operating stage associated with the first stage call for heating may be adjusted to include an 80 percent firing rate of the burner 157 instead of a 70 percent firing rate. After adjusting the initial operating stage associated with the first stage call for heating, a second stage call for heating may be received. In response to receipt of the second stage call for heating, an operating cycle of the furnace system 150 may be initiated at an associated initial operating stage that includes a 100 percent firing rate of the burner 157. In response to a determination that stored durations of time of recent operating cycles associated with second stage calls for heating progressively decrease for a threshold quantity of consecutive operating cycles, the initial operating stage associated with the second stage call for heating may be adjusted to include a 90 percent firing rate of the burner 157 instead of the 100 percent firing rate (e.g., without adjusting the initial operating stage associated with the first stage call for heating). After the initial operating stage associated with the second stage call for heating is adjusted, a first stage call for heating may be received, and an operating cycle of the furnace system 150 may be initiated with the previously-adjusted initial operating stage associated with the first stage call for heating having the 80 percent firing rate of the burner 157 in response. In this manner, adjustments made to an initial operating stage associated with a first type of call for heating may be maintained independent of adjustments made to an initial operating stage associated with a second type of call for heating.

Although each of FIGS. 6-8 primarily discusses operation of the furnace system 150 to satisfy a call for heating, any of the features or techniques described herein may be implemented in any other suitable HVAC system to satisfy a different call for conditioning, such as a call for cooling and/or a call for dehumidification. For example, in response to receipt of a call for conditioning, the control system 158 may initiate an operating cycle of the HVAC system at an initial operating stage that may include an initial operating capacity, speed, and/or frequency of a compressor (e.g., the compressor 42, 74), an initial speed of a fan (e.g., the fans 32, the fan 64), an initial opening of an expansion device (e.g., the expansion device 78), and the like. The initial operating stage may be adjusted based on stored durations of time of recent operating cycles of the HVAC system to satisfy previous calls for conditioning and enable the HVAC system to operate more suitably to satisfy a subsequent call for conditioning.

The present disclosure may provide one or more technical effects useful in the operation of an HVAC system. For example, an operating cycle of a furnace system may be initiated at an initial operating stage to satisfy a call for heating. Respective durations of time of operating cycles to satisfy calls for heating may be monitored and stored. In response to a determination that the stored durations of time of recent operating cycles progressively increase for a threshold quantity of consecutive recent operating cycles, the initial operating stage may be adjusted to provide increased heating in response to a subsequent call for heating. Furthermore, in response to a determination that the stored durations of time of recent operating cycles progressively decrease for a threshold quantity of consecutive recent operating cycles, the initial operating stage may be adjusted to provide reduced heating in response to a subsequent call for heating. In this manner, initial operating stages of the furnace system may be adjusted to enable the furnace system to heat a space more efficiently (e.g., more quickly, utilizing less energy). The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and/or air conditioning (HVAC) system, comprising:

a control system configured to:

initiate an operating cycle of a furnace of the HVAC system at an initial operating stage in response to a call for heating;

monitor a duration of time associated with the operating cycle of the furnace to satisfy the call for heating;

compare respective durations of time of recent operating cycles of the furnace;

in response to a determination that the respective durations of time of recent operating cycles of the furnace increase or decrease for a threshold quantity of consecutive recent operating cycles, adjust the initial operating stage to provide an adjusted initial operating stage of the furnace; and initiate a subsequent operating cycle of the furnace at the adjusted initial operating stage.

2. The HVAC system of claim 1, wherein the control system is configured to:

adjust an operating parameter of the initial operating stage to provide the adjusted initial operating stage to increase heating by the furnace in the subsequent operating cycle in response to a determination that the respective durations of time of recent operating cycles increase for the threshold quantity of consecutive recent operating cycles; and adjust the operating parameter of the initial operating stage to provide the adjusted initial operating stage to reduce heating by the furnace in the subsequent operating cycle in response to a determination that the respective durations of time of recent operating cycles decrease for the threshold quantity of consecutive recent operating cycles.

3. The HVAC system of claim 2, wherein the operating parameter comprises a speed of a draft inducer motor of the furnace, a firing rate of a burner of the furnace, a position of a fuel valve of the furnace, or any combination thereof.

4. The HVAC system of claim 1, comprising a thermostat configured to transmit the call for heating to the control system, wherein the thermostat is configured to transmit the call for heating in response to a determination that a difference between a measured temperature associated with a space conditioned by the HVAC system and a target temperature associated with the space exceeds a threshold value.

5. The HVAC system of claim 4, wherein the measured temperature is a temperature of a return air flow received by the HVAC system from the space.

6. The HVAC system of claim 4, wherein the thermostat is a conventional or non-communicating thermostat.

7. The HVAC system of claim 1, wherein the control system is configured to block adjustment of the initial operating stage at which the subsequent operating cycle of the HVAC system is initiated in response to a determination that the respective durations of time of recent operating cycles do not increase or decrease for the threshold quantity of consecutive recent operating cycles.

8. The HVAC system of claim 1, wherein the initial operating stage is associated with an operating parameter value of the furnace, and the control system is configured to adjust the operating parameter value during the operating cycle.

* * * * *